United States Patent [19]

Ellis, Jr.

[11] 4,218,685

[45] Aug. 19, 1980

[54] COAXIAL PHASED ARRAY ANTENNA

[76] Inventor: Robert A. Frosch, Administrator of the National Aeronautics and Space Administration, with respect to an invention of Haynes Ellis, Jr., Chino, Calif.

[21] Appl. No.: 953,313

[22] Filed: Oct. 17, 1978

[51] Int. Cl.[2] ..... H01Q 21/26

[52] U.S. Cl. ..... 343/727; 343/797; 343/789

[58] Field of Search ..... 343/725, 729, 730, 786, 343/854, 727, 797, 789

[56] References Cited

U.S. PATENT DOCUMENTS

| | | | |
|---|---|---|---|
| 3,545,001 | 12/1970 | Giller | 343/776 |
| 3,740,754 | 6/1973 | Epis | 343/797 |
| 3,864,687 | 2/1975 | Walters et al. | 343/778 |
| 4,042,935 | 8/1977 | Ajioka | 343/797 |

*Primary Examiner*—Eli Lieberman

*Attorney, Agent, or Firm*—Carl O. McClenny; John R. Manning; Marvin F. Matthews

[57] ABSTRACT

Disclosed is a coaxial antenna array for communicating circularly polarized electromagnetic radiation. A pair of open ended antenna cavities is coaxially constructed and operates by excitation of linear radiation elements arranged within each of the cavities. A pair of crossed-dipole radiation devices are centered within the inner cavity and operated by means of a phase-shifting network circuit to transmit as well as receive circularly polarized radiation. Four monopole radiation devices are symmetrically arranged to operate in the outer cavity in phase quadrature by means of the phase-shifting network circuit to also both transmit and receive circularly polarized electromagnetic radiation. Combined operation of the two antenna cavities with a 180° phase differential between the fields related to the two antenna cavities provides a broad beam, relatively wide frequency bandwidth communication capability. Particular embodiments disclosed feature a generally square cavity array as well as a circular cavity array.

9 Claims, 9 Drawing Figures

COAXIAL PHASED ARRAY ANTENNA

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. Field of the Invention

The present invention pertains to antennas for transmitting and/or receiving electromagnetic radiation. More particularly, the present invention relates to apparatus for communicating circularly polarized radiation by means of linear radiation excitation elements arranged in coaxially arrayed cavities.

2. Description of Prior Art

The use of antennas for both transmitting and receiving electromagnetic radiation is well known. A variety of approaches to antenna construction is followed with a particular antenna design selected generally on the basis of several factors. These factors may include, among others, the frequency range in which the antenna is to function, physical size limitations on the antenna, mobility requirements, if any, the radiation pattern desired, and the nature and degree of the polarization of the radiation to be communicated. All of these factors may be critical when the antenna in question is mounted for operation on an aircraft or spacecraft. In such case, for example, the antenna must generally be compact and light weight, and able to function in a variety of orientations of the craft relative to the ground, and the station with which the craft is communicating.

In the case of spacecraft operating at high altitudes and communicating with a ground level station, polarization effects produced in wave fronts incident on boundaries between atmospheric layers can reduce signal strength significantly. Therefore, it is often desirable to conduct such radiation communication by utilizing circularly polarized radiation whereby the atmosphere-induced polarization effects are minimized.

Antennas constructed for flush mounting in spacecraft and other high flying craft are generally known to exhibit relatively narrow frequency bandwidth transmitting and receiving capabilities. Furthermore, to accommodate the flush mounting, such prior art antennas are generally constructed such that the spread of the effective radiation pattern is limited. Thus, to provide relatively uniform communication capability to a craft regardless of the craft orientation, the number of such antennas required to be arranged about the craft is increased.

SUMMARY OF THE INVENTION

An antenna according to the present invention includes at least two coaxially arranged antenna cavities. The inner antenna cavity features a pair of dipole radiation devices, arranged in crossed-dipole configuration centered on the cavity. Four monopole radiation devices are arranged symmetrically about the cavity array to operate in the outer cavity. Two such monopole devices are positioned mutually diametrically opposed across the inner cavity, and aligned along a common direction with one of the dipole radiation devices. The remaining two monopole radiation devices are also positioned mutually diametrically opposed across the inner cavity, along the direction of orientation of the other dipole radiation device. Thus, the first two monopole devices and one dipole device are positioned and oriented along a first direction that is orthogonal to a second direction along which the remaining dipole and monopole devices are positioned and oriented.

In one embodiment, the coaxial cavities are defined, in part, by inner and outer walls each generally outlining a square. The two squares are concentric, and have common corresponding axes of rotational symmetry. The two mutually orthogonal directions of orientation of the radiation elements then lie along diagonals of the squares.

In another embodiment, the two cavities are defined, in part, by inner and outer walls which outline circles. These circles are concentric, having a common longitudinal axis, or axis of cylindrical symmetry. Then, the two mutually orthogonal directions of orientation of the radiation devices lie along diameters of the two circles. In each such embodiment, the antenna cavities are generally longitudinally coextensive.

The individual linear radiation devices may be of conventional design, but are structured such that one of the monopole devices operates 180° out of phase with the diametrically opposed monopole device.

An operating circuit is provided and joined to the radiation devices by feed connections. The entire assembly may be used to both transmit and receive electromagnetic radiation. In the transmit mode, a signal is input to the network circuit and divided to be fed to all six linear radiation devices. The network circuit also effects a phase shift of 90° between the signals as provided to the two dipole devices. Further, the network provides a 180° phase differential between the feed to the dipole devices compared to the feed to the monopole devices. The two monopole devices structured to operate in phase are provided signals which are 90° out of phase with the signals provided to the remaining monopole devices. Thus, the crossed-dipole configuration may illuminate the inner cavity to transmit either right-circularly polarized or left-circularly polarized radiation. Similarly, the outer cavity may be illuminated by means of the array of monopole devices to transmit either right-circularly polarized or left-circularly polarized radiation. With the two cavities illuminated 180° out of phase, the transmissions from both cavities combine to a single signal of circularly polarized radiation.

To operate in the receive mode, the antenna array receives a signal from a remote location which results in the excitation of the six radiation elements. The resulting six signals from the radiation devices are fed to the network circuit and appropriately combined and phase-shifted, in a manner opposite to that utilized in the transmission mode, to produce a single signal embodying the information thus communicated from a remote location.

The present invention provides a coaxial array of antenna cavities operable by excitation of linear radiation devices whereby the antenna assembly may be flush-mounted yet provides a broad beam radiation pattern. Further, such an antenna assembly may be constructed compactly, and is operable in a limited aperture installation. While as in the case of antennas in general the frequency range in which antennas according to the present invention are operable are determined, at least in part, by their physical dimensions, the frequency bandwidths in which such antennas are operable are generally broader than those of comparable size antennas designed for flush mounting.

DESCRIPTION OF PREFERRED EMBODIMENTS

Figure 1:
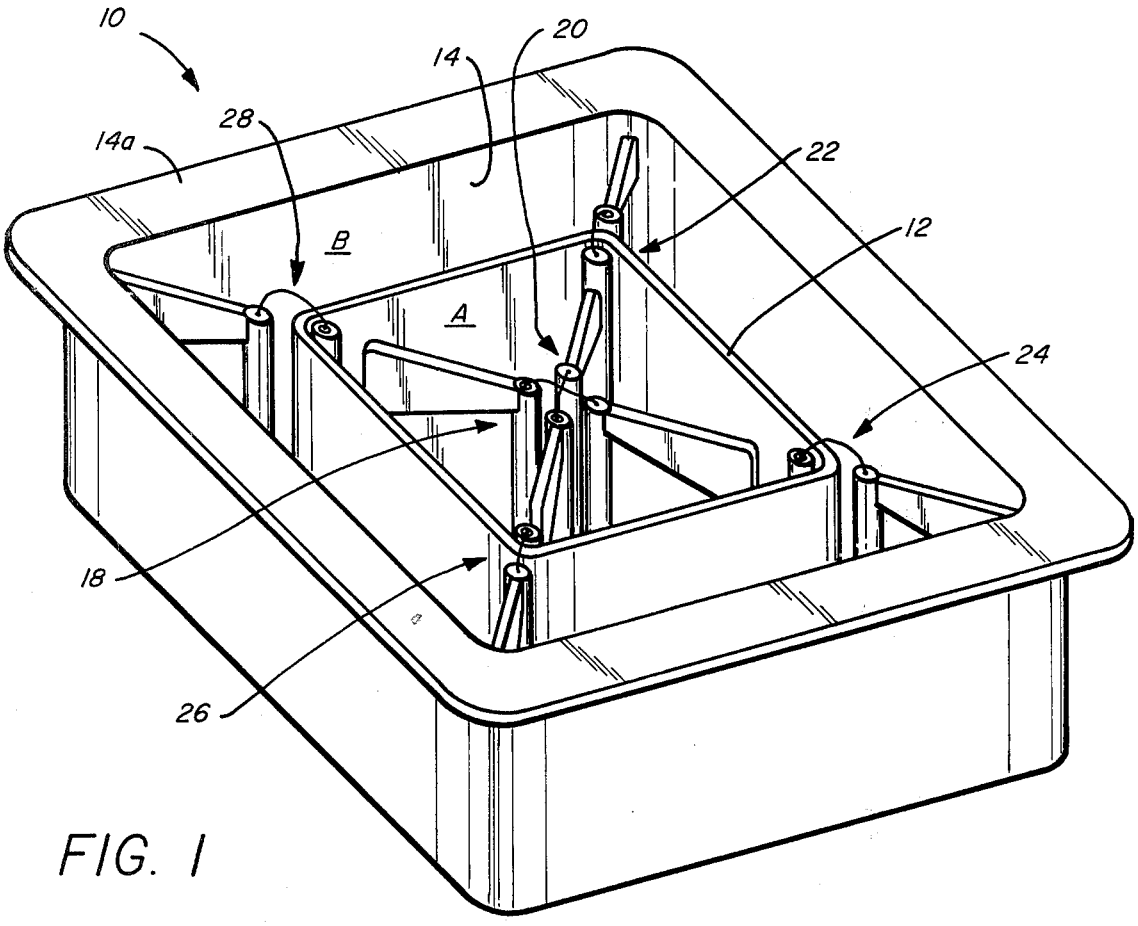
FIG. 1 is a perspective view of a coaxial phased array antenna assembly according to the present invention.
Figure 2:
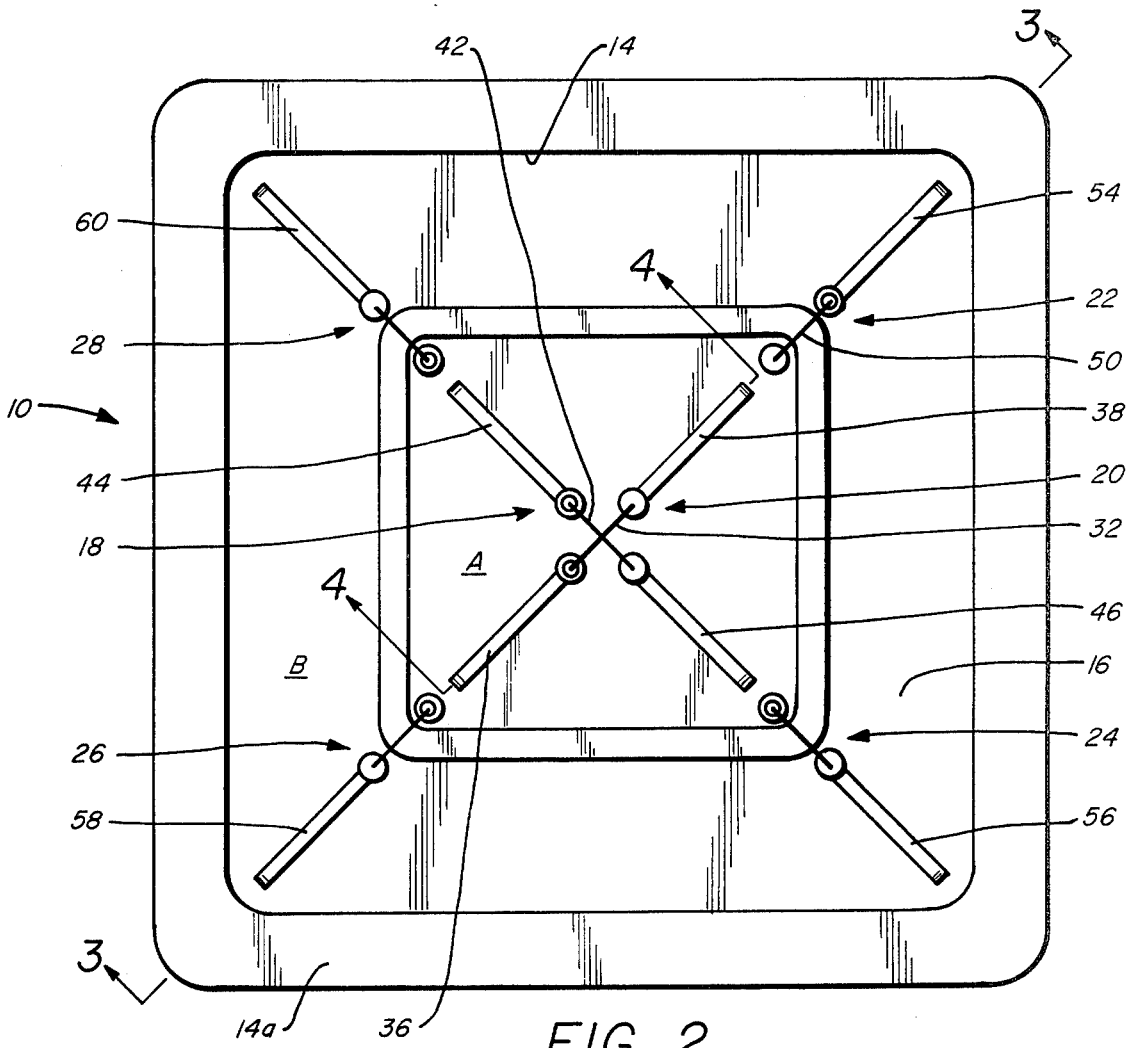
FIG. 2 is a plan view of the antenna assembly shown in FIG. 1.

An antenna assembly according to the present invention is shown generally at 10 in FIGS. 1 and 2. A pair of walls 12 and 14 cooperate with a base 16 (FIG. 3) to define inner and outer cavities A and B, respectively. The inner cavity A is limited by the interior surface of the inner wall 12 and the top surface of the cavity base 16. The outer cavity B is limited by the interior surface of the outer wall 14, the exterior surface of the inner wall 12, and the top surface of the cavity base 16.

Figure 3:
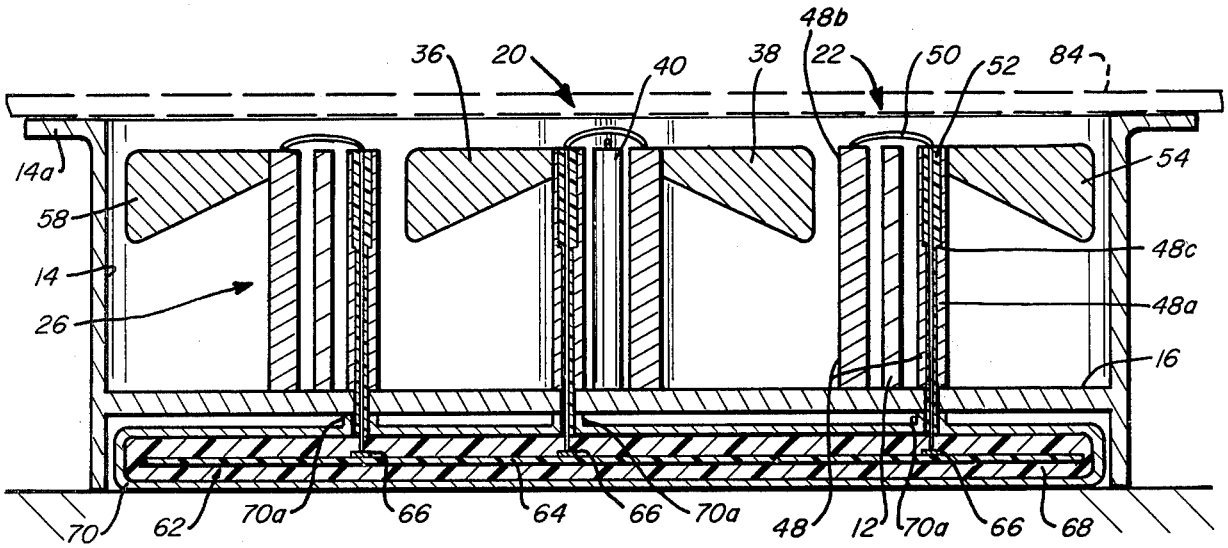
FIG. 3 is a cross sectional view taken along line 3—3 of FIG. 2.

It may be appreciated from FIG. 2 that the inner cavity A is square in horizontal cross section, and the outer cavity B forms a square with a central square portion, established by the exterior surface of the interior wall 12, removed. It will be appreciated that the inner and outer walls are mutually coaxial, and the two cavities A and B are also mutually coaxial. Further, the two cavities A and B have a common center as well as mutually parallel corresponding sides. As FIGS. 1 and 3 show, the cavities A and B are also generally axially coextensive, with their respective bottoms, at the same axially location, defined by the top surface of the same base 16. The height of the outer wall 14 is slightly greater than that of the inner wall 12, for a purpose discussed hereinafter.

A pair of dipole electromagnetic radiation devices shown generally at 18 and 20 are arranged within the inner cavity A in a crossed-dipole configuration. Monopole radiation devices 22, 24, 26 and 28 are located at the four corners of the interior wall 12.

Figure 4:
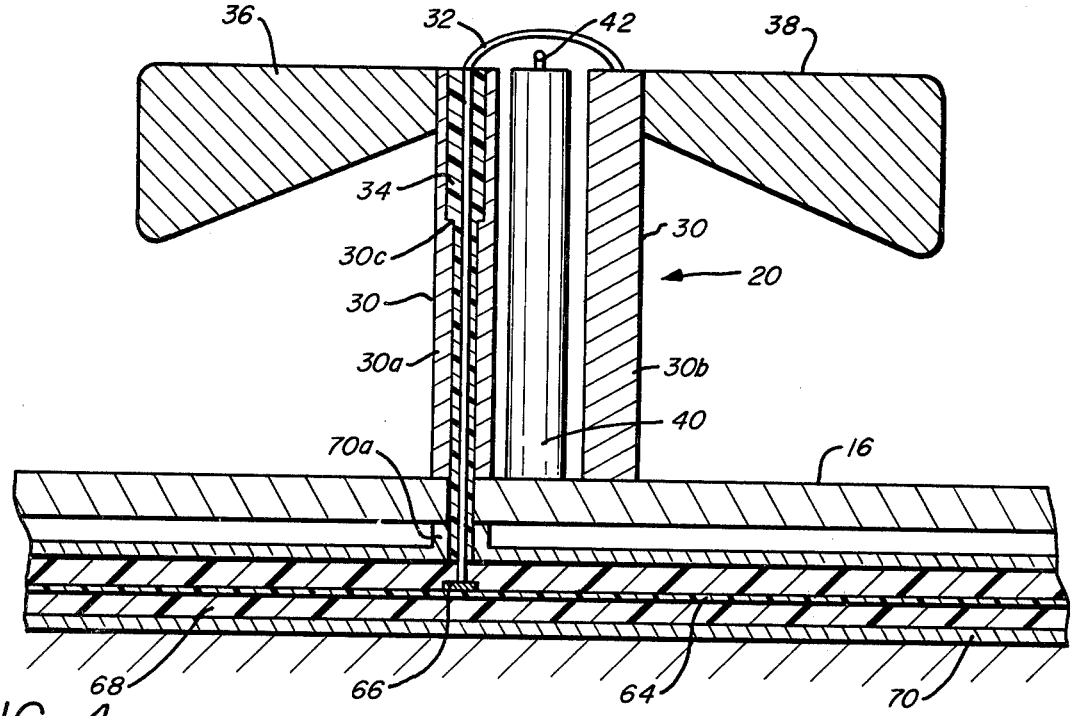
FIG. 4 is an enlarged cross sectional view of a dipole radiation device taken along line 4—4 in FIG. 2, and showing details of the balun structure.

The configurations and structures of the radiation devices may be especially appreciated by reference to FIGS. 3 and 4. In particular, dipole device 20 is shown in FIG. 4 to be supported on the base 16 by a balun 30 including a balanced post **30*a* and an unbalanced post 30*b*. The balanced post 30*a* is a coaxial structure containing, as a central core, a transmission line 32 which extends from below the base 16, up through the balun post 30*a* and over to the top of the unbalanced portion 30*b* to which the transmission line is mechanical and electrically anchored. Both balun portions 30*a* and 30*b* are made of conducting material such as a metal. However, within the balanced post 30*a* the transmission line 32 is electrically insulated from the conducting outer portion of the balun by a dielectric material 34**.

As seen in FIGS. 3 and 4, the dielectric material 34 contained in the balanced segments of the baluns of all the radiation devices varies in thickness between a relatively wide section in the upper portion of the balun segment to a relatively narrow section in the lower portion of the balun segment. The transition between the two sections of different thickness in a particular balun is marked by a shoulder such as **30*c* in the balanced balun segment 30*a***.

The dielectric material 34 serves as a transmission line transformer for the corresponding radiation device. It is known to vary the length of the wider section of the dielectric 34 to vary the impedance of the transmission line and radiation device combination to match the network feeding the transmission line.

Further, it is known to vary the dimensions of an antenna cavity and associated radiation devices to vary the center of the wavelength band of radiation able to be communicated by such an antenna assembly. In particular, with a structure such as cavity A and radiation devices 18 and 20, the height of the radiation devices is approximately one quarter of the wavelength of the center of the excitation band. The same relationship between radiation device height and radiation excitation frequency applies to the exterior cavity B and associated radiation devices 22 through 28.

Thus, the physical dimensions of the cavities A and B and the radiation devices 20 through 28 may be altered to vary the central frequency of the radiation band communicable by such an antenna assembly, and the length of the wider portion of dielectric 34 present in the balanced balun segments of the radiation devices may be varied to match the impedance thereof with the network coupled with the transmission lines passing through those balun segments.

The dipole radiation device 20 is equipped with a pair of radiation elements 36 and 38, each radiation element supported by separate balun segment **30*a* and 30*b*, respectively. The radiation elements 36 and 38** are oriented along a common direction but extend in opposite senses.

The other dipole radiation device at 18 is constructed similarly to dipole radiation device 20, with a two-post balun 40 (FIGS. 3 and 4) and transmission line 42. Also, the posts of the balun 40 are each fitted with a radiation element 44 and 46, respectively. The radiation elements 44 and 46 are likewise oriented to extend in opposite senses along a common direction.

As clearly visible in FIGS. 1 and 2, the dipole radiation devices at 18 and 20 are positioned and oriented within the inner cavity A such that the four balun posts in question are arranged in a square centered on the center of the cavity A, and such that balun posts of the same radiation device are located at opposite corners of the balun post square. The two transmission lines 32 and 42 cross at approximately the center of the cavity A without making mutual electrical contact. The direction along which the radiation elements 36 and 38 are oriented is orthognal to the direction along which the radiation elements 44 and 46 are oriented. These directions lie in mutually orthogonal planes which include the common central longitudinal axis of both cavities A and B.

Each of the monopole radiation devices 22–28 is constructed in a manner similar to that of each of the dipole radiation devices 18 and 20. The similarities and the differences in construction between the two types of radiation devices may best be appreciated by reference to FIGS. 2 and 3. Thus, for example, monopole radiation device 22 includes a balun 48 with balanced and unbalanced balun segments 48*a* and 48*b*, respectively. The balanced balun segment 48*a* includes a transmission line 50 passing therethrough and crossing over to connect with the top of the unbalanced balun post 48*b*. The transmission line 50 is insulated from the conducting material of the balanced post 48*a* by dielectric material 52 serving as the transmission line transformer, and which varies in thickness with the transition between different thicknesses marked by a shoulder 48*c*.

The two balun posts 48*a* and 48*b* of the monopole radiation device 22 stradle the inner wall 12 at one corner thereof. Similarly, each of the other monopole radiation devices 24–28 include a balun constructed of two posts which also stradle the inner wall 12, one such monopole device located at each corner of the wall 12. The monopole radiation device at 22 includes only one radiation element 54, supported by the balun post exterior of the inner wall 12. Similarly, each of the other three monopole radiation devices 24, 26 and 28 possesses only one radiation element 56, 58, and 60, respectively, all monopole radiation elements being positioned within the outer cavity B.

All of the radiation elements 54–60 of the monopole radiation devices are oriented to extend generally away from the inner cavity A. Thus, as may be appreciated from FIGS. 1 and 2, two monopole radiation devices 22 and 26 are positioned mutually diametrically opposed across the interior cavity A with their respective radiation elements 54 and 58 lying generally along the direction of orientation of the dipole radiation elements 36 and 38, and extending in opposite senses away from the common central longitudinal axis of the two cavities A and B. Similarly, the other two monopole radiation devices at 24 and 28 are positioned mutually diametrically opposed across the interior cavity A with their respective radiation elements 56 and 60 extending away from the interior cavity in opposite senses along the same direction as the direction of orientation of the dipole radiation elements 44 and 46.

In the case of three of the monopole radiation devices 24–28, the transmission lines are carried by the balun posts located within the inner wall 12, while the transmission line of the fourth monopole radiation device at 22 is carried by the balun post located in the exterior cavity B. This latter monopole radiation device at 22 is also located adjacent the radiation element 38 supported by the unbalanced balun post of the dipole radiation device at 20.

The relationship between the positioning of the balanced and unbalanced segments of the diametrically positioned monopole radiation devices at 22 and 26 establishes a 180° phase relationship between the excitation of the corresponding radiation elements 54 and 58. Then, with the network circuit shown and described hereinafter, circularly polarized electromagnetic radiation may be both received and transmitted by the monopole antenna array in the outer cavity B.

Similarly, the crossed-dipole arrangement of the dipole radiation devices at 18 and 20 within the inner cavity A enables circularly polarized electromagnetic radiation to be both received and transmitted by the dipole antenna arrangement of the inner cavity.

A network for operating the antenna assembly to both receive and transmit electromagnetic signals is shown schematically in FIG. 3 at 62. A dielectric lamina, such as a film strip, 64 may typically be used as a base or substrate for the network components. The network circuit may be constructed by depositing copper or other conducting material on one or both sides of the base 64, and attaching additional circuit components thereto. As one alternative, the network circuit may be constructed by beginning with a laminar sandwich of a conducting plane and a dielectric substrate, and possibly a second conducting plane on the opposite side of the substrate, and selectively etching material from the one or more conducting planes to leave a circuit on the substrate as required. These and other strip line circuit construction techniques are well known, and will not be further discussed herein.

The various transmission lines, such as 50, extend down from the balanced balun segments through appropriate holes in the cavity base 16 and to the area of the network circuit as shown. At the network base 64, the transmission lines are joined to the network circuit at connections, or traces, 66.

The network circuit may be enclosed in additional dielectric material 68 which isolates the network circuit from a surrounding housing made of electrically conducting material 70. The conducting housing 70 serves as a ground plane for the transmission network. Appropriate passageways are provided, such as 70*a*, for passing the transmission lines from the radiation devices through the ground plane housing 70 to the network circuit. The dielectric material 14 within the balanced balun posts may continue downwardly through the cavity base 16 and the passageways 70*a* to insure that the transmission lines are insulated from these two conducting objects.

The continuations of the transmission lines directly to the network circuit 62 act as feed lines between the network circuit and the radiation devices. While the present arrangement indicated in FIG. 3 has the advantage of a compact construction, the network circuit itself may be provided at a location remote from the antenna assembly proper. In such case, more extensive lines must connect the network circuit to the radiation devices. Also, the transmission line transformers within the balanced balun posts, exhibited by the wide and narrow segments of the dielectric material 34, must be provided so as to insure a proper impedance match along the network circuit-feed line-transmission line hookup.

Figure 6:
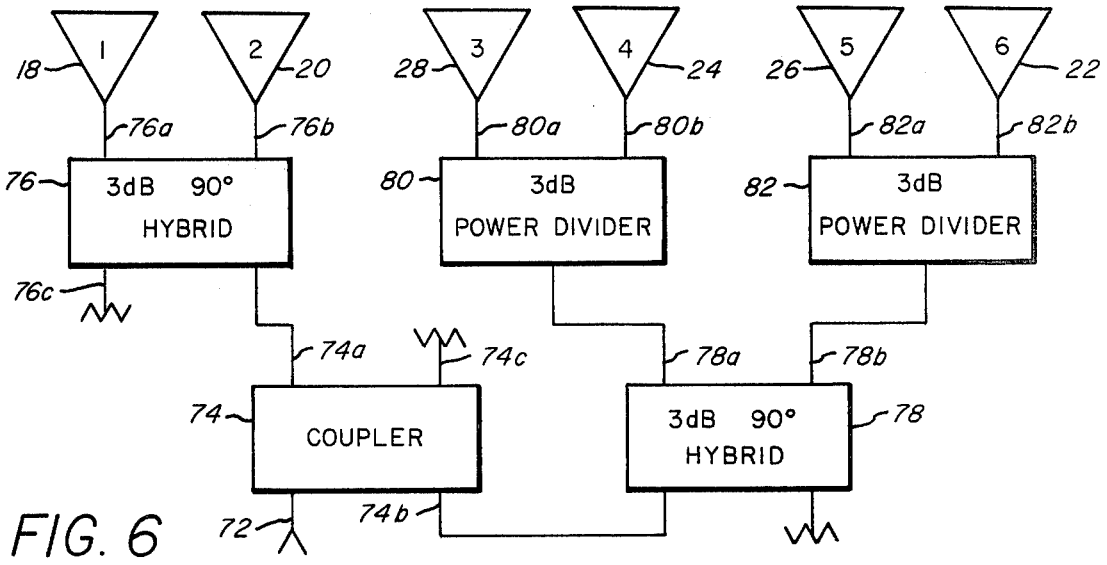
FIG. 6 is a schematic diagram of a network circuit which may be utilized to operate the present antenna assembly.

A typical network circuit that may be utilized in operating the antenna assembly of the present invention is shown schematically in FIG. 6. The network circuit is designed to cooperate with the balun post arrangement of the antenna assembly, as well as the positioning of the radiation devices in general, to enable circularly polarized electromagnetic radiation to be communicated by the antenna assembly.

The signal to be transmitted by the antenna assembly is introduced to the network circuit at the input 72 to a coupler 74. The coupler 74 is essentially an inductive device which passes the input signal to an output 74*a* and excites the same frequency signal in a parallel branch output at 74*b*. The opposite end of the parallel branch is an isolation port 74*c*, which terminates the induced signal to the ground plane through an impedance matching device. The coupler 74, as well as the remaining circuit devices to be described, is a conventional device well known in the strip line circuitry field, and will not be discussed in further detail herein.

In the present case, the induced signal is output from the coupler 74 at terminal 74*b* in a physically reversed direction compared to the orientation of the input and output directions at 72 and 74*a*, respectively. Thus, the coupler 74 effects a 180° phase shift between the input signal 72 and the inductively generated signal provided at terminal 74*b*.

The output signals at 74*a* and 74*b* from the coupler 74 are fed to combination signal splitters and phase shifters 76 and 78, respectively. Each of these elements 76 and 78 is a 3 DB 90° phase shifting hybrid power divider. Thus, for example, the hybrid power divider 76 feeds the input signal from 74*a* to two output terminals 76*a* and 76*b*, at equal power levels, but 90° out of phase. Inductive coupling is used between the input circuit, which terminates at an isolation port 76*c*, and the output circuit with output terminals 76*a* and 76*b*. Thus, two output signals are produced by the signal splitter at terminals 76*a* and 76*b*, which output signals are essentially identical in all respects, with the exception that the two output signals are mutually 90° out of phase. Similarly, the signal splitter 78 provides two essentially identical output signals at terminals 78*a* and 78*b*, which signals are also 90° out of phase.

The two output signals from the signal splitter 78 are fed to separate 3 DB power dividers 80 and 82. Each of these two elements 80 and 82 functions to split its input signal to provide two output signals which are essentially identical in all respects, and mutually in phase as well. Thus, output signals are provided at the power divider terminals 80*a* and 80*b* which are mutually in phase, and output signals are provided at the power divider terminals 82*a* and 82*b* which are also mutually in phase. However, there is a 90° phase differential between the signals from terminals 80*a* and 80*b* compared to the signals from terminals 82*a* and 82*b* due to the phase shift effected by the hybrid power divider 78.

The output signals from the hybrid signal splitter 76 are fed to the two dipole radiation devices 18 and 20, respectively, represented symbolically in FIG. 6 as elements 1 and 2. The output signals from the power divider 80 are similarly fed to the diametrically opposed monopole radiation devices 28 and 24, represented symbolically as elements 3 and 4, respectively. Also, the output signals from the power divider 82 are fed to the remaining diametrically opposed monopole radiation devices 26 and 22, represented symbolically by elements 5 and 6, respectively. The dipole radiation devices within the inner cavity A thus receive their signals 90° out of phase. The resulting signal transmitted by the inner cavity portion of the antenna assembly is circularly polarized. It will be appreciated that the sense of rotation of the circularly polarized electromagnetic radiation thus transmitted by the inner cavity portion of the antenna assembly is determined by the sense of the phase shift provided by the hybrid signal splitter 76. Therefore, by reversing the feed connections between the dipole radiation devices 18 and 20 relative to the signal splitter 76, the sense of rotation of the circularly polarized electromagnetic radiation transmitted by the inner cavity portion of the antenna assembly may be reversed.

As noted hereinbefore, the two monopole radiation devices 24 and 28 receive their two signals in phase, but 90° out of phase relative to the reception of the two signals by the remaining two monopole radiation devices 22 and 26. However, the feed to the monopole radiation device 22 is effected through the balun post which supports the radiation element 54, as opposed to the feeding of the other three monopole radiation devices occuring through the balun posts located within the inner cavity A. This difference in feed to the two diametrically opposed monopole radiation devices 22 and 26, which otherwise receive their input signals from the power divider 82 in phase, effects a 180° phase shift in the signals actually transmitted by the two radiation elements 54 and 58. Thus, by a combination of the phase shifting effected in the network circuitry as illustrated in FIG. 6, and the construction and positioning of the various monopole radiation devices 22 through 28, the signal provided by element 58 is 90° out of phase with the signals provided by elements 56 and 60, which are mutually in phase and 90° out of phase with the signal provided by element 54. Also, there is a 180° phase differential between the signals provided by elements 58 and 54. Thus, the total signal transmitted by the outer cavity portion of the antenna assembly is also circularly polarized. Furthermore, the sense of rotation of the circularly polarized signal thus transmitted by the outer portion of the antenna assembly may be reversed by simply reversing the output terminal connections of the hybrid signal splitter 78.

Excitation by the dipole radiation elements within the inner cavity A results in the transmission of a circularly polarized signal. Similarly, excitation of the monopole radiation elements in the outer cavity B of the antenna assembly results in the transmission of a circularly polarized signal as well. Due to the phase shift effected by the coupler 74, the dipole radiation elements illuminate the inner cavity 180° out of phase with the illumination of the outer cavity B effected by the monopole radiation elements. With the coaxial arrangement of the two antenna portions, the two individual signals then combine to a single signal of circularly polarized electromagnetic radiation, whose rotational sense may be reversed by simply reversing the feed line connections of the two hybrid signal splitters 76 and 78 as noted hereinbefore.

Figure 7:
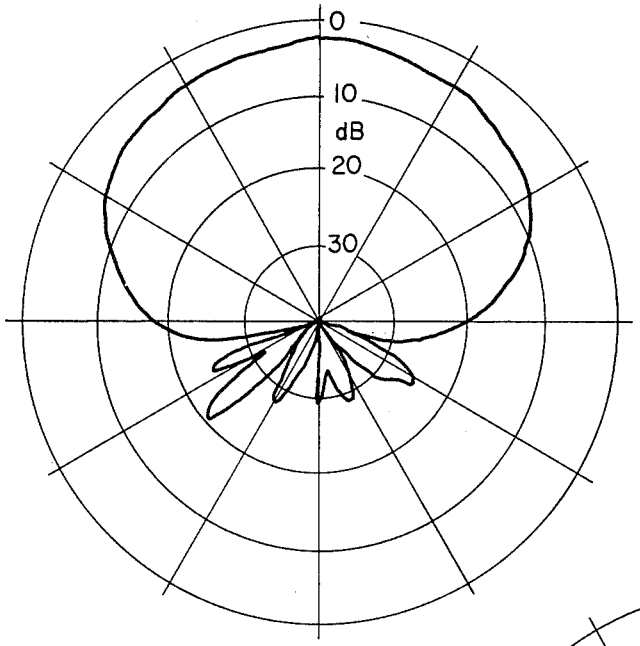
FIG. 7 is a graphical representation of a radiation pattern which may be generated by use of the crossed-dipole section of the antenna assembly alone.
Figure 8:
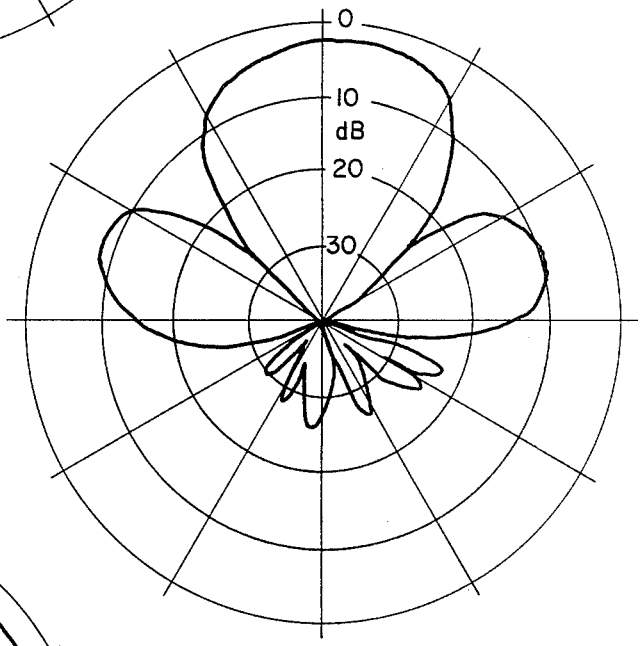
FIG. 8 is a graphical representation of a radiation pattern which may be generated by use of the multiple monopole section of the antenna assembly alone.
Figure 9:
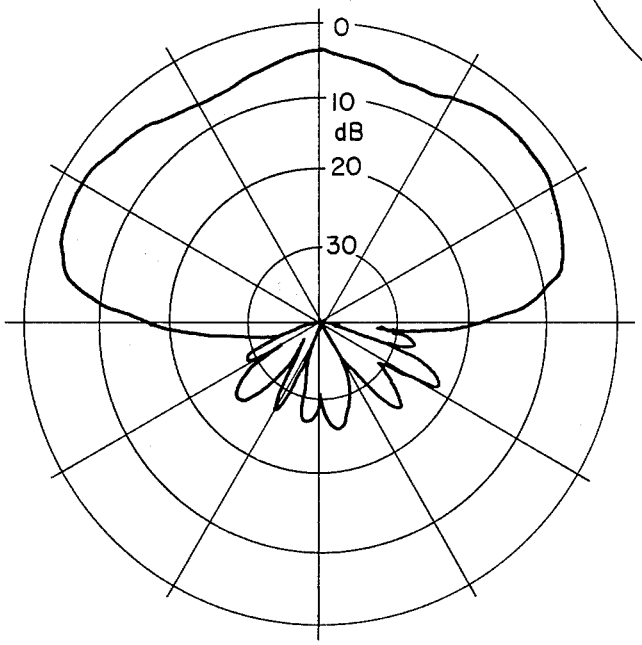
FIG. 9 is a graphical representation of a radiation pattern that may be generated by illuminating both the monopole and dipole antenna sections according to the present invention.

The general radiation pattern characteristic of the inner cavity A illuminated by the crossed-dipole radiation elements is illustrated in FIG. 7 for a plane perpendicular to the aperature of the cavity A. Similarly, the general pattern of radiation characteristic of the outer cavity B as illuminated by the four monopole radiation devices operated in phase quadrature is illustrated in FIG. 8 for a plane normal to the aperature of the outer cavity B. The combined antenna assembly with the inner and outer cavities illuminated 180° out of phase as discussed hereinbefore generates a radiation pattern as given by FIG. 9 for a plane normal to the aperatures of both cavities A and B. It will be appreciated, by a comparison of FIGS. 7–9, that the coaxial array of antenna cavities illuminated by linear radiation elements excited according to the phase relationships described hereinbefore provides a radiation pattern of greater effective beam width than that of either of the antenna cavities operated alone. Further, the frequency bandwidth produced in the transmitted signals by the coaxial antenna array of the present invention is broader than that obtainable by either of the two antenna cavity portions operating alone.

The coaxial array antenna assembly of the present invention is also operable to receive circularly polarized electromagnetic radiation. In such case, the antenna assembly operates as a receiving antenna, with the incoming signals entering the cavities A and B and exciting both the dipole and monopole radiation elements. The received signals are then fed along the transmission lines of the six radiation devices through the feed connectors to the network circuitry previously described. The network circuit of the type illustrated in FIG. 6 operates to combine the individual signals induced in the various radiation devices. Then, the signal splitters 76–82 combine paired signals input thereto at the respective terminals previously identified as output terminals. Finally, the coupler 74 combines the two signals received by the inner and outer cavity antenna portions into a single signal presented at 72. The signal thus received by the antenna array and processed by the network circuit of FIG. 6 is provided for further processing by conventional receiver or other equipment.

The antenna assembly of the present invention may be flush-mounted, for example, in a spacecraft or other vehicle. For this purpose, the outer cavity wall 14 may be extended slightly above the height of the inner cavity wall 12, and provided with an externally extending flange **14*a* as shown in FIGS. 1–3. The flange 14*a* may serve to facilitate the installation of the antenna array with an outer covering 84 as illustrated by dashed lines in FIG. 2. The greater height of the outer wall 14*a* above the base 16 compared to the height of the inner wall 12 raises the covering 84 above the top of the inner wall 12** and the balun posts of the radiation elements to accomodate the extension of the transmission lines above the balun posts.

The covering 84 may include various environmental protection elements, such as a heat shield, necessitated by the particular application of the present invention. It will be appreciated that, whatever its other characteristics, the covering 84 must be at least partially transparent to electromagnetic radiation in the frequency range of communication by the antenna assembly.

Figure 5:
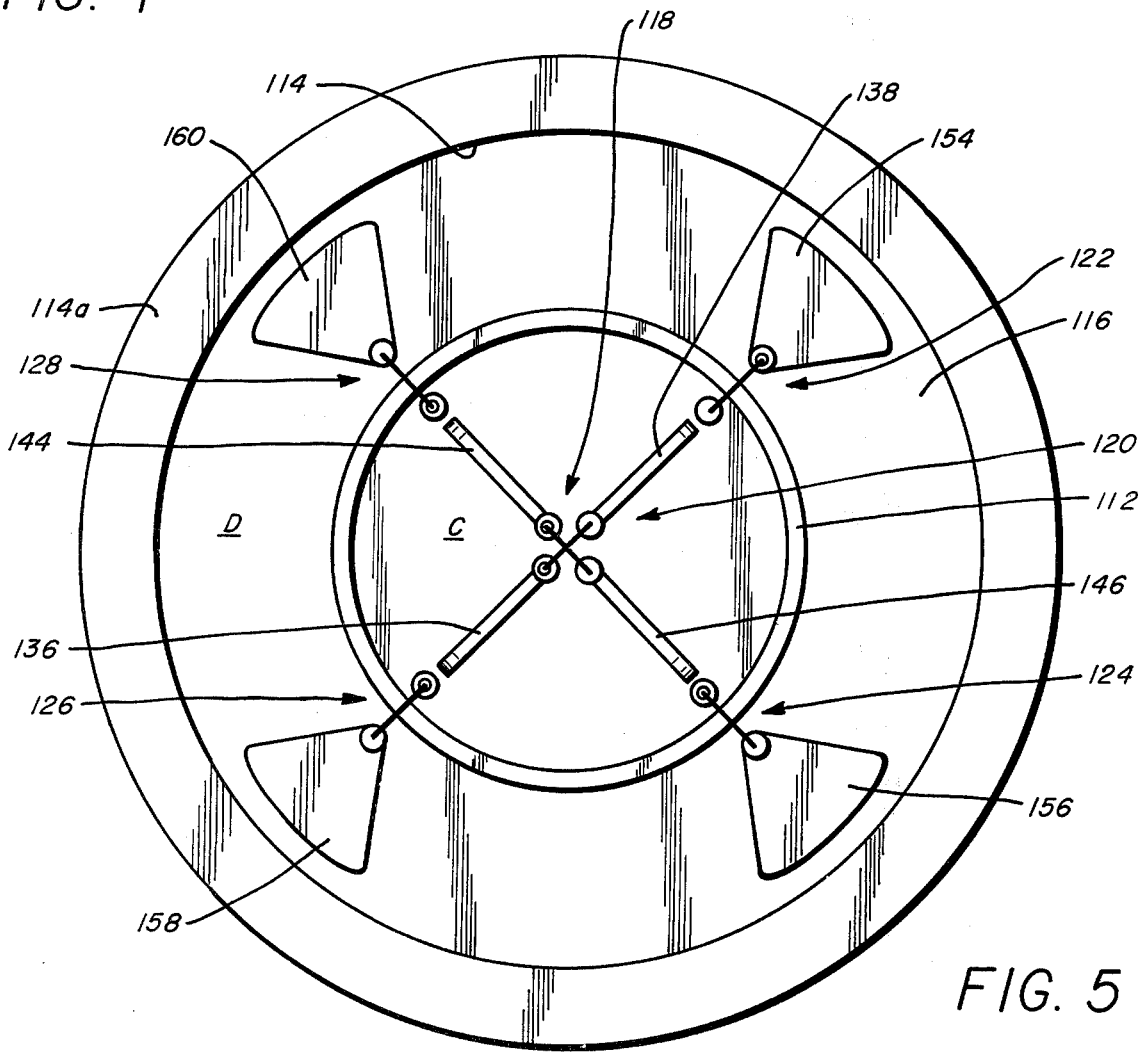
FIG. 5 is a plan view of an embodiment of the present invention featuring circular cavities.

The present invention may also be constructed in the form of coaxial circular antenna cavities as illustrated in FIG. 5 wherein certain elements which may be essentially identical in structure and/or function to those previously described are identified by numerals differing in value by 100 from the numerals used to identify the corresponding elements.

An inner antenna cavity C is limited by an inner circular wall 112 and the top surface of a cavity base 116. An outer antenna cavity D is defined by the inner surface of an outer circular wall 114, the outer surface of the inner wall 112, and the top surface of the cavity base 116. The outer wall 114 is fitted with a top outwardly extending flange **114*a*** for purposes of mounting and/or covering the antenna array as discussed hereinbefore in relation to the square antenna array embodiment.

A crossed-dipole configuration including dipole radiation devices 118 and 120 is centered within the inner cavity C. The dipole radiation device 118 includes radiation elements 144 and 146 extending in opposite senses along one diameter of the inner cavity circular cross section; the other dipole radiation device 120 includes radiation elements 136 and 138 extending in opposite senses along a second diameter of the inner cavity C cross section, which second diameter is perpendicular to the first diameter.

The radiation elements of the dipole devices 118 and 120 are of the same type as those of the dipole devices 18 and 20 of the previously discussed embodiment. Thus, all such dipole radiation elements of both embodiments are in the general form of planar, radially extending flags lying in planes which include the longitudinal axis of the corresponding inner cavity.

As in the case of the square antenna array embodiment, the circular antenna array includes four monopole radiation devices for excitation in the outer cavity D. Radiation devices 122 and 126 are positioned mutually diametrically opposed along the direction of orientation of the dipole device 120. Similarly, monopole radiation devices 124 and 128 are positioned mutually diametrically opposed along the direction of orientation of the dipole device 118.

By comparing FIGS. 2 and 5, it will be appreciated that the balun post arrangement of the square embodiment is generally repeated in the circular embodiment with the balun posts of the monopole radiation devices straddling the inner wall 112 in the latter case. Further, three of the monopole devices 124, 126, and 128 are fed by transmission lines passing through balanced balun posts located within the inner wall 112, while the fourth monopole device is structured with its balanced balun post located in the outer cavity D. This particular monopole device 122 is also positioned with its unbalanced balun post adjacent the radiation element 138 supported by an unbalanced balun post of the dipole radiation device 120. The various transmission lines in each case also cross from the balanced posts to the unbalanced balun posts for each radiation device.

The radiation elements of the monopole devices of the square antenna assembly embodiment are also in the general form of planar, radially extending flags lying in planes including the longitudinal axis of the coaxial antenna cavities. However, the monopole radiation devices 122–128 include radiation elements 154, 156, 158 and 160, respectively, in the general form of planar flags of a pie-cut type shape, lying in a common plane perpendicular to the common longitudinal axis of the two cavities C and D, and positioned in the vicinity of the top of the various balun posts. Further, each of the flag elements 154–160 is positioned symmetrically about the diameters of the cavities C and D along which the radiation device of which the flag is a part is positioned.

The performance of the antenna array with generally circular cavities is generally the same as that previously described in connection with the square antenna array assembly. Thus, the individual cavities C and D, being illuminated separately, may be expected to provide radiation patterns as illustrated in FIGS. 7 and 8, respectively, while the combined signal radiation pattern obtained by operating both cavities C and D together resembles that illustrated in FIG. 9. Thus, the broadened radiation beam width as well as extended frequency bandwidth may be achieved by constructing the coaxial antenna array of the present invention in either a generally square or circular pattern. Further, the network circuitry shown in FIG. 6, and the general construction of the network and feed connections illustrated in FIG. 3 and described in connection therewith may be employed with the circular type antenna array of the present invention for both transmitting and receiving circularly polarized electromagnetic radiation. Then, for example, radiation devices 118, 120, 122, 124, 126 and 128 may be represented in FIG. 6 as elements 1, 2, 6, 4, 5 and 3, respectively.

The antenna assembly of the present invention provides a coaxial array of antenna cavities operated by excitation of linear antenna radiation elements arranged and operated in phase quadrature with coincidental phase centers to produce and receive circularly polarized illumination.

The beam width and frequency bandwidth available for communication by means of the present invention are both greater than corresponding values found in prior art circularly polarized antennas featuring flush-mountings in large ground planes.

Due to its coaxial construction, an antenna according to the present invention is particularly adaptable for installation in limited space enclosures and for communication through limited apertures. Such, antennas are capable of exercising full operation potential even though flush-mounted.

In a particularly advantageous application, four individual coaxial antenna assemblies according to the present invention may be spaced apart 90° about the roll plane of a spacecraft to utilize the $\pi$ steradian coverage of the radiation pattern exhibited by one such antenna assembly, as illustrated in FIG. 8. Further, the relative compactness and light weight of antennas constructed according to the present invention are additional features desirable in the case of vehicle applications, such as in spacecraft.

The foregoing disclosure and description of the invention is illustrative and explanatory thereof, and various changes in the details of the illustrated apparatus may be made within the scope of the appended claims without departing from the spirit of the invention.

We claim:

1. An antenna assembly for communicating electromagnetic radiation comprising:

(a) first antenna cavity means defined by the interior surface of a first wall, generally circumscribing said first cavity means, and the surface of a base;

(b) second antenna cavity means defined by the interior surface of a second wall, generally circumscribing said second cavity means, the exterior surface of said first wall, and the surface of a base, and wherein said second antenna cavity means generally circumscribes said first antenna cavity means, is substantially axially coextensive therewith, and possesses a common central, longitudinal axis therewith;

(c) first and second dipole radiation means, positioned in cross-dipole configuration within said first antenna cavity means wherein each of said first and second dipole radiation means include balun means comprising, a balanced segment and an unbalanced segment, and radiation element means such that each balun segment supports a radiation element means, both radiation element means thus supported by a single balun means being oriented along a common direction and in opposite senses away from each other, the direction of orientation of the radiation element means of said first dipole radiation means being orthogonal to the direction of orientation of the radiation element means of said second dipole radiation means; and, (d) first, second, third, and fourth monopole radiation means positioned symmetrically relative to said second antenna cavity means for excitation therein and wherein (1) each of said first, second, third, and fourth monopole radiation means includes balun means, each comprising a balanced segment and an unbalanced segment, and radiation element means such that only one balun segment of each said monopole radiation means supports a radiation element means;

(2) the balun means of each said monopole radiation means is positioned such that, in each such case, the balun segment supporting a radiation element means is located within said second cavity means with said radiation element means supported thereby oriented along a direction generally away from said first antenna cavity means, and said other balun segment not supporting a radiation element means is located within said first antenna cavity means;

(3) said first and third monopole radiation means are positioned mutually diametrically opposed across said first antenna cavity means along the direction of orientation of said radiation element means of said first and third monopole radiation means extending in opposite senses generally along said direction; and (4) said second and fourth monopole radiation means are positioned mutually diametrically opposed across said first antenna cavity means along said direction of orientation of said radiation element means of said second dipole radiation means, said radiation element means of said second and fourth monopole radiation means extending in opposite senses along said direction of orientation.

2. An antenna assembly as defined in claim 1 wherein three of said monopole radiation means are structured such that their balun means balanced segments are within said first antenna cavity means, and the other said monopole radiation element means is structured such that its balun means balanced segment is located within said second antenna cavity means.

3. An antenna assembly as defined in claim 2 wherein said monopole radiation means with its balun means balanced segment located within said second antenna cavity means is positioned with its balun means unbalanced segment adjacent the radiation element means supported by a balun means unbalanced segment of one of said dipole radiation means.

4. An antenna assembly as defined in claim 3 further comprising:

(a) network means, for feeding signals to said dipole and monopole radiation means for transmission by said antenna assembly, or for receiving signals from said dipole and monopole radiation means received by said antenna assembly; and (b) feed means for coupling said dipole and monopole radiation means with said network means for communication therewith.

5. An antenna assembly as defined in claim 4 wherein:

(a) the transverse cross section of said first antenna cavity means is generally square; and (b) the transverse cross section of said second antenna cavity means is a plane figure generally square in exterior boundary and limited by a generally square interior boundary, said two boundaries being concentric and with mutually parallel corresponding sides.

6. An antenna assembly as defined in claim 5 wherein all said radiation element means are generally planar and oriented in planes in which lies the common longitudinal axis of said first and second cavity means.

7. An antenna assembly as defined in claim 4 wherein:

(a) the transverse cross section of said first antenna cavity means is generally circular; and (b) the transverse cross section of said second antenna cavity means is a plane figure with exterior limit that is generally circular and interior limit that is generally circular, and concentric with said exterior limit.

8. An antenna assembly as defined in claim 7 wherein:

(a) said radiation element means of said dipole radiation means are generally planar and oriented in planes containing the common longitudinal axis of said first and second antenna cavity means; and (b) said radiation element means of said monopole radiation means are generally planar and oriented in planes perpendicular to the common longitudinal axis of said first and second antenna cavity means.

9. An antenna assembly as defined in claim 1 wherein:

(a) each of said first and second dipole radiation means include balun means, comprising a balanced segment and an unbalanced segment, and radiation element means such that each balun segment supports a radiation element means, both radiation element means thus supported by a single balun means being oriented along a common direction and in opposite senses away from each other, the direction of orientation of the radiation element means of said first dipole radiation means being orthognal to the direction of orientation of the radiation element means of said second dipole radiation means;

(b) each of said first, second, third and fourth monopole radiation means includes balun means, each comprising a balanced segment and an unbalanced segment, and radiation element means such that only one balun segment of each said monopole radiation means supports a radiation element means;

(c) the balun means of each said monopole radiation means is positioned such that, in each such case, the balun segment supporting a radiation element means is located within said second cavity means with said radiation element means supported thereby oriented along a direction generally away from said first antenna cavity means, and said other balun segment not supporting a radiation element means is located within said first antenna cavity means;

(d) said first and third monopole radiation means are positioned mutually diametrically opposed across said first antenna cavity means along the direction of orientation of said radiation element means of said first dipole radiation means, said radiation element means of said first and third monopole radiation means extending in opposite senses generally along said direction; and (e) said second and fourth monopole radiation means are positioned mutually diametrically opposed across said first antenna cavity means along said direction of orientation of said radiation element means of said second dipole radiation means, said radiation element means of said second and fourth monopole radiation means extending in opposite senses along said direction of orientation.

* * * * *